US006237668B1

(12) United States Patent
Hitchings

(10) Patent No.: US 6,237,668 B1
(45) Date of Patent: May 29, 2001

(54) FOLDING CONVERTIBLE SCREEN/DISPLAY

(76) Inventor: Hitchings, 20967 Caleb Jones Rd., Ewell, MD (US) 21824

( * ) Notice: Subject to any disclaimer, the term of this patent is extended or adjusted under 35 U.S.C. 154(b) by 0 days.

(21) Appl. No.: 09/439,176

(22) Filed: Nov. 12, 1999

(51) Int. Cl.[7] ..... A47G 5/00
(52) U.S. Cl. ..... 160/135; 160/351; 40/610
(58) Field of Search ..... 160/135, 351; 40/124.09, 539, 610

(56) References Cited

U.S. PATENT DOCUMENTS

| | | | |
|---|---|---|---|
| D. 286,108 | * | 10/1986 | Hanlon . |
| 1,714,550 | * | 5/1929 | Dreher . |
| 1,734,782 | * | 11/1929 | Stam . |
| 3,601,916 | | 8/1971 | Epstein . |
| 3,630,309 | * | 12/1971 | Wenger . |
| 3,889,736 | | 6/1975 | Firks . |
| 3,975,850 | * | 8/1976 | Giamme . |
| 4,436,135 | | 3/1984 | Ytter . |
| 4,759,520 | * | 7/1988 | Levine . |
| 4,830,080 | | 5/1989 | Densen . |
| 4,838,600 | | 6/1989 | Wischusen . |
| 4,981,152 | | 1/1991 | Laurent . |
| 5,352,149 | | 10/1994 | Melashenko et al. . |
| 5,370,249 | | 12/1994 | Harvey et al. . |
| 5,418,020 | | 5/1995 | Crane . |
| 5,429,432 | | 7/1995 | Johnson . |
| 5,775,034 | | 7/1998 | Logue . |
| 5,911,522 | | 6/1999 | Wood . |
| 5,960,848 | * | 10/1999 | Schirer . |

FOREIGN PATENT DOCUMENTS

| | | | | |
|---|---|---|---|---|
| 616783 | * | 1/1949 | (GB) | 40/539 |
| 621433 | * | 4/1949 | (GB) | 40/539 |
| 708230 | * | 4/1954 | (GB) | 40/539 |

* cited by examiner

*Primary Examiner*—Blair M. Johnson
(74) *Attorney, Agent, or Firm*—Thomas C. Steidel

(57) ABSTRACT

A folding convertible screen/display made from rigid, structural material, comprising a floor and three walls, positionable and free-standing on a support surface without formal assembly at the point of usage, is disclosed. An optional continuous top provides additional structural integrity and definition to the space delineated by the screen/display, without adding complexity. Being of unit construction, the screen/display is simple to manufacture, decorate, set up, use and fold for compact transport and storage.

12 Claims, 4 Drawing Sheets

FOLDING CONVERTIBLE SCREEN/DISPLAY

BACKGROUND

1. Technical Field of the Invention

The present invention relates to a novel apparatus for defining a discrete space for a specific, temporary purpose. The apparatus described is a floored, portable, modular, convertible, collapsible three-sided embrasure constructed from one or more pieces of rigid, structural material, positionable and free-standing on a support surface without formal assembly at the point of usage. Further, the apparatus is of unit construction, making it simple to manufacture, decorate, set up, use and fold or break down for compact storage.

2. Description of Related Art

Screens and displays are commonly used in retail sales and trade shows to delineate limited areas for singular uses, most often to present products or services to potential users or buyers. U.S. Pat. No. 5,418,020, issued May 23, 1995, to inventor Stanley A. Crane, describes one such simple display. This display provides only two sides, and lacks a floor and other features which might further set off the area it is intended to define, or provide structural integrity. Further, this display provides no integrated means to secure it in an open or erected position. Embellishments to this and similar basic designs, such as shelves and literature holders, add utility and function to such displays, but complicate manufacturing, assembly and set up/break down operations. Where there exists a need to provide a temporary display or screen which can be easily and quickly dismantled and compactly stored, these embellished designs fall short due to their complexity.

What is needed, then, is a design which better defines a discrete space for a definite temporary purpose, supporting additional features while preserving simplicity and ease of manufacturing, assembly, use and storage. The design should also provide an integrated means for securing the display or screen in its opened or erected position, while addressing the need for the apparatus to be easily and quickly folded into a compact, readily transported, reusable package.

SUMMARY OF THE INVENTION

Various advantages of this invention become readily apparent upon reading the accompanying drawings and descriptions set forth herein. Specifically, one of the advantages of this invention is that, once manufactured and assembled, it is of unit construction; that is, it consists of a singular piece of rigid, structural material, rather than several distinct and separate pieces which must be disassembled and reassembled with each folding and erecting operation of the apparatus. This unitized construction insures ease and convenience in use, transport and storage.

Another advantage of this invention is that it is essentially free-standing, and does not require the use of additional supporting members.

Still another advantage of this invention is that the apparatus, when erected, is secured in position, yet can be easily collapsed and folded into a compact form.

These and other advantages not described but inherently obvious to the reader are fully embraced by this invention.

BRIEF DESCRIPTION OF THE DRAWINGS

A more complete understanding of the apparatus of this invention may be gained by reading the following detailed description while referring to the accompanying drawings herein.

DETAILED DESCRIPTION

Figure 1:
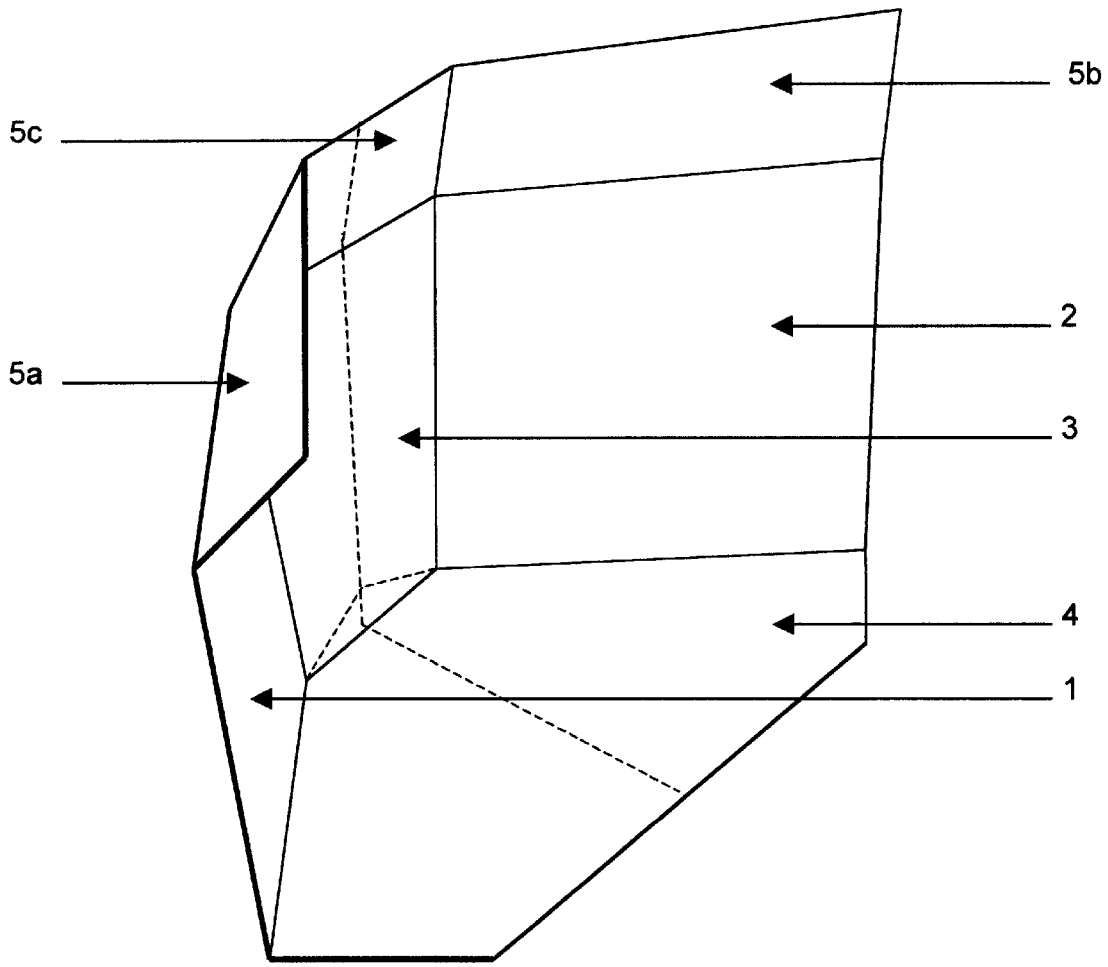
FIG. 1 is a three-dimensional drawing depicting a typical folding convertible screen/display based upon this invention.

FIG. 1 is a three-dimensional drawing depicting a typical folding convertible screen/display based upon this invention. The screen/display comprises not only left and right walls 1 and 2, but also a center wall 3 between them, a floor 4, and optional angled top sections 5*a*, 5*c* and 5*b* integral with and tangential to the top edges of the walls 1, 3 and 2 respectively. These optional angled top sections, not found in other designs, provide additional structural integrity and definition to the space delineated by the screen/display, without adding complexity.

Though manufactured from a plurality of pieces of rigid, structural material such as corrugated paperboard, the screen/display, once assembled by flexibly joining its pieces, is of unit construction; that is, it consists of a singular piece of rigid, structural material, rather than the several distinct and separate pieces from which it was designed and made. The obvious advantage in this design over others lies in the ease by which the screen/display can be used, since the apparatus does not consist of a number of pieces which must be disassembled and reassembled with each break-down and set-up.

Figure 2:
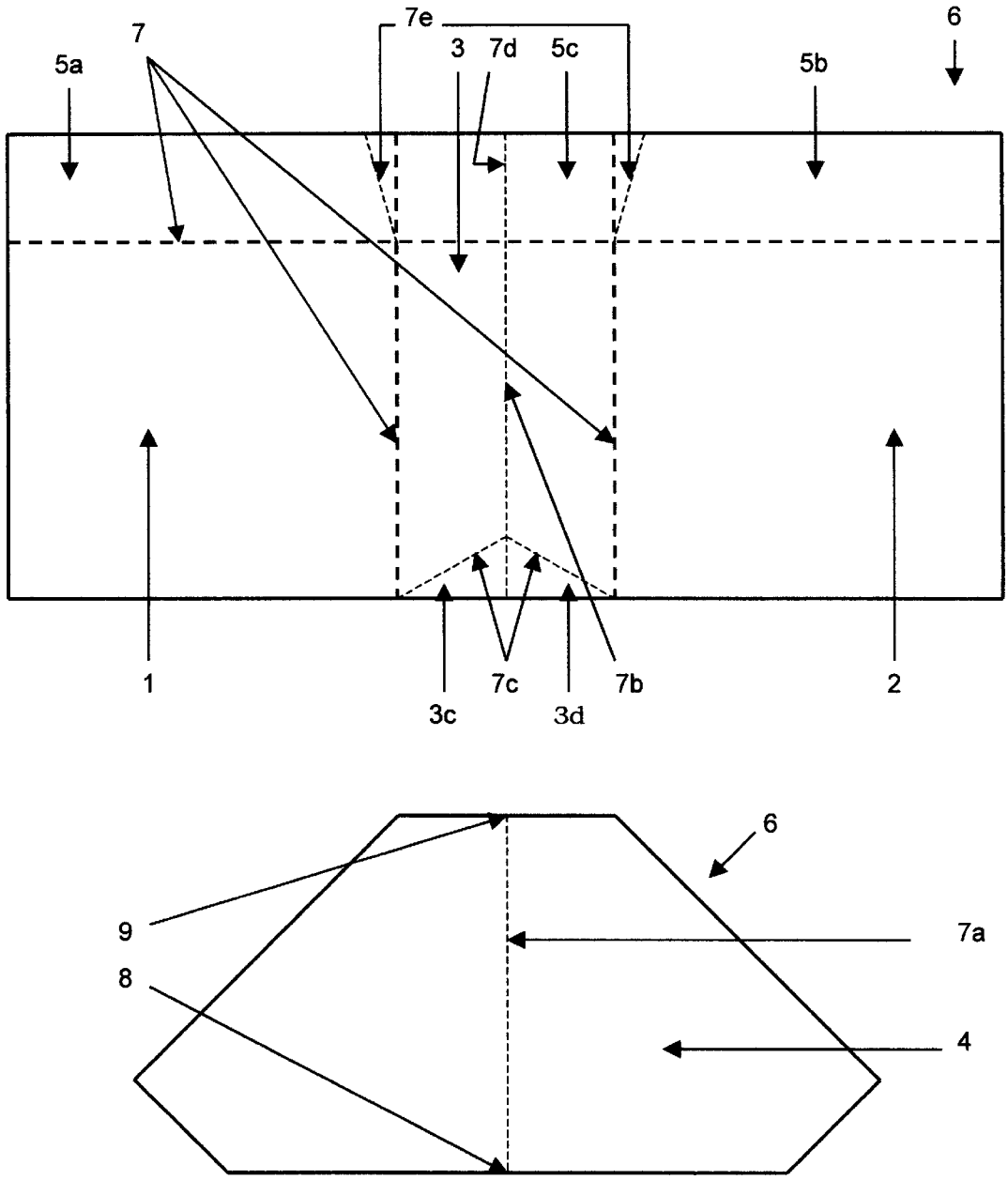
FIG. 2 is a design drawing which describes the wall, floor and optional top panels of a typical folding convertible screen/display based upon this invention.

FIG. 2 is a design drawing which describes the wall, floor and optional top panels of a typical folding convertible screen/display based upon this invention. A left wall 1, a center wall 3, and a right wall 2, as well as the floor 4 and the optional angled top sections 5*a*, 5*c* and 5*b*, may be formed from a single contiguous piece of material 6, or of separated pieces from material 6. Flexible joints 7 define the boundaries between adjacent walls 1 and 3, and 3 and 2, as well as between walls 1, 3 and 2 and adjacent optional angled top sections 5*a*, 5*c* and 5*b*, and, further, between walls 1, 3 and 2 and the adjacent edges of floor 4 where they are flexibly joined together when assembled. They also describe the folded edges of the apparatus when it is erected for use. These flexible joints 7, and other flexible joints described herein, serve further to facilitate bending when assembling, folding and erecting the screen/display, and may be formed by scoring and folding along predetermined lines where the rigid, structural material is corrugated paperboard, and the flexible joints are permanently formed. Central flexible joint 7*b* bisects the center wall 3 from top edge to bottom edge. A medial flexible joint 7*a* bisects the floor 4, extending from the midpoint 9 of the floor edge to be flexibly joined to the bottom edge of center wall 3, to the midpoint 8 of an opposite floor edge. Supplemental flexible joints 7*c* permit the folding convertible screen/display to fold from an open, erect position into its compact, folded form for transport and storage. Middle flexible joint 7*d* bisects the optional angled top section 5*c* from top edge to bottom edge. Additional flexible joints 7*e* allow small segments of optional angled top sections 5*a* and S*b* to be folded in behind optional angled top sections 5*a* and 5*b*, or, in the alternative, behind optional angled top section 5*c*, thereby causing the optional angled top sections 5*a*, 5*c* and 5*b* to bend inward toward the floor of the screen/display. The segments of optional angled top sections 5*a* and 5*b* bounded by flexible joints 7 and 7*e* may be secured behind optional angled top sections 5*a*, 5*b* or 5*c* by any temporary means. The resulting optional angled top portion of the screen/display adds rigidity to the opened, erected apparatus.

Figure 3:
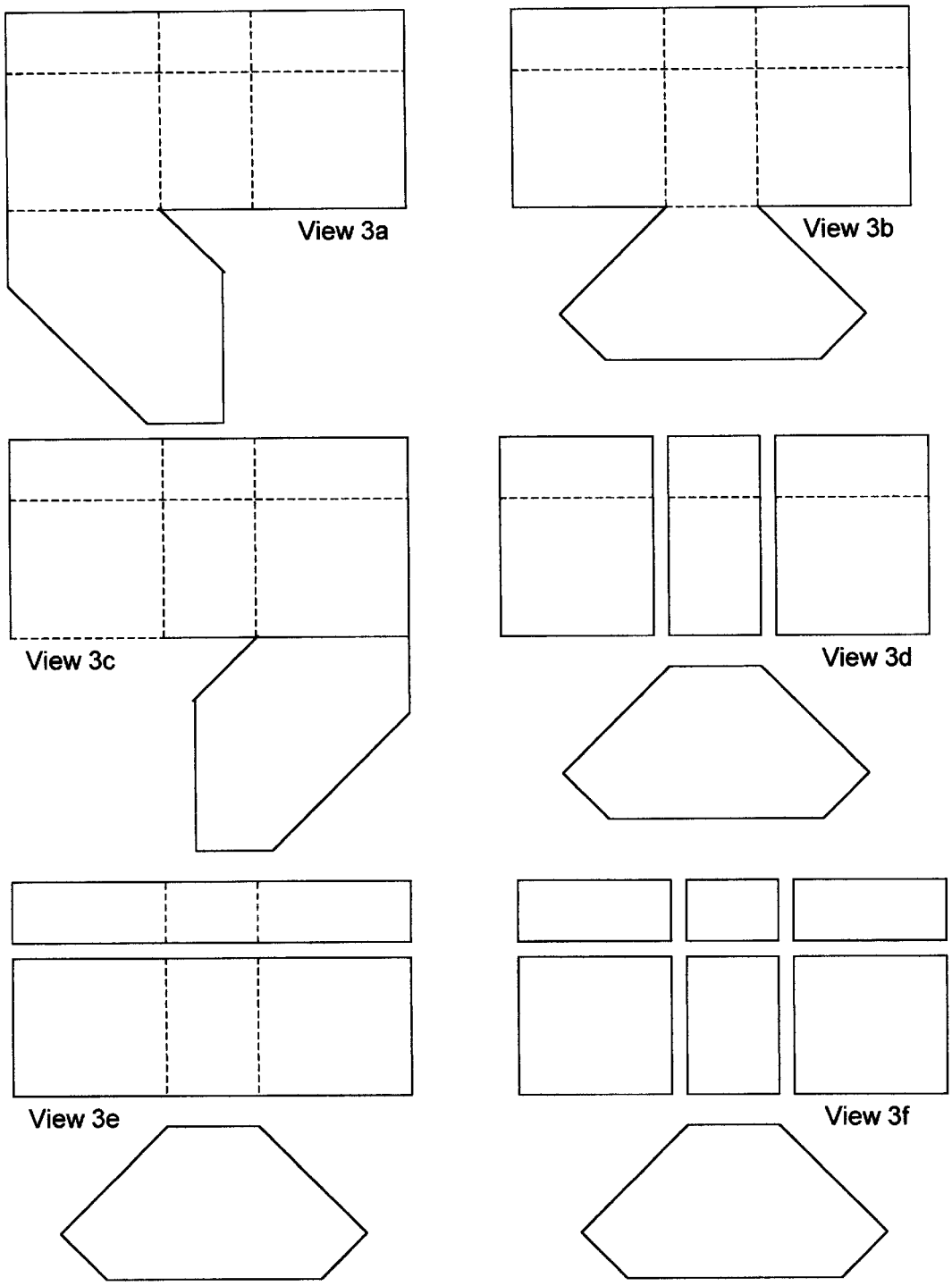
FIG. 3, in a series of views, depicts a plurality of means by which the walls, floor and optional angled top sections may be formed from one or more pieces of rigid, structural material.

FIG. 3, in a series of views, depicts a plurality of the many means by which the walls, floor and optional angled top sections may be formed from one or more pieces of rigid, structural material. Views 3*a*, 3*b* and 3*c* of FIG. 3 show the walls, optional angled top sections and floor formed from a single, contiguous piece of material, where the floor is permanently and flexibly joined to the left, center and right walls, respectively, and the optional angled top sections are permanently and flexibly joined to the three walls., Views 3*d*, 3*e* and 3*f* of FIG. 3 show the walls, optional angled top sections and floor formed of separated pieces of rigid, structural material.

Figure 4:
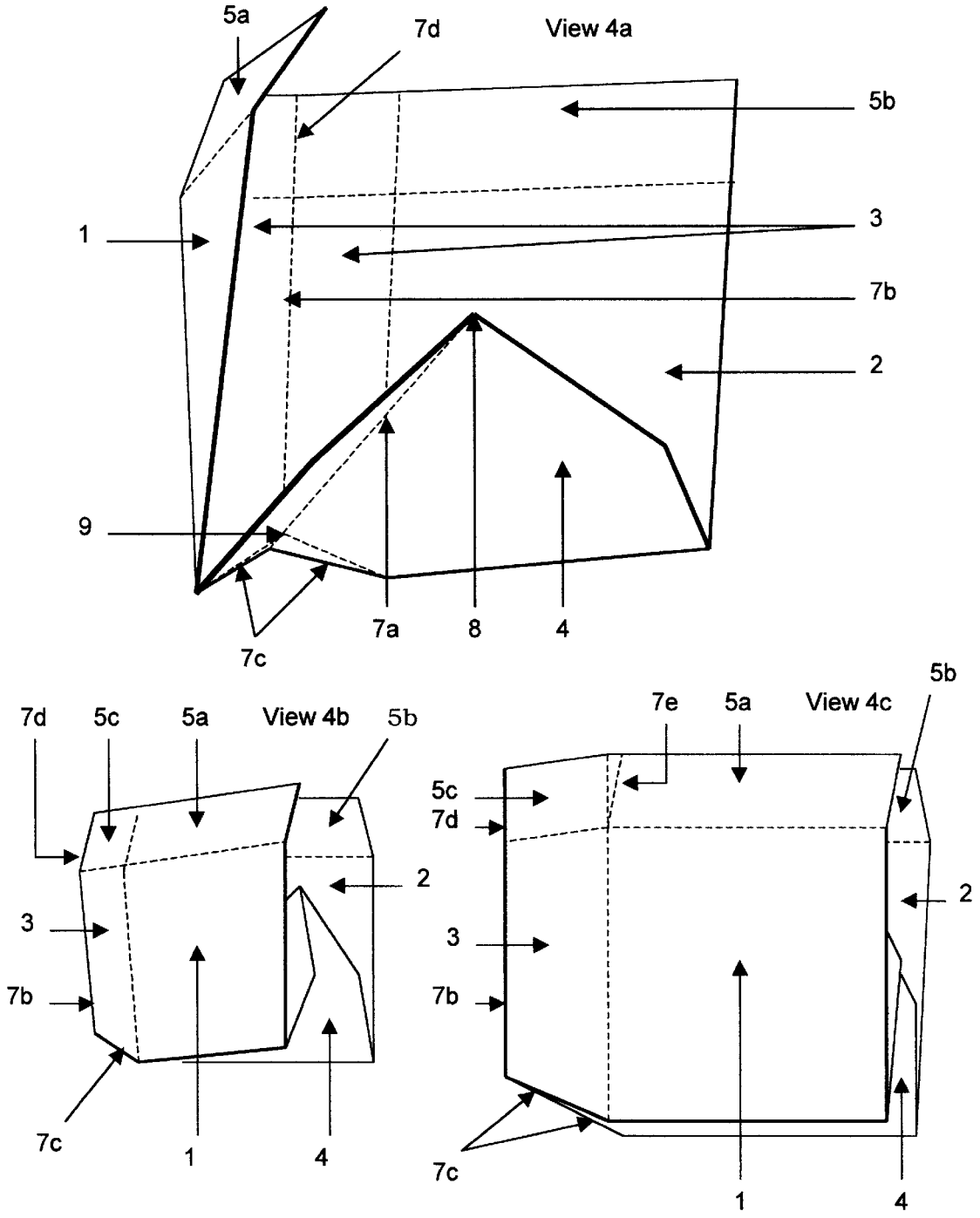
FIG. 4 is a simplified three-dimensional drawing depicting the way in which a typical folding convertible screen/display based upon this invention collapses and folds for storage.

FIG. 4 is a simplified three-dimensional drawing depicting the way in which a typical folding convertible screen/display based upon this invention collapses and folds for portable transport, storage and later reuse. Folding of the screen/display begins by pushing the floor 4 at the midpoint of its inside edge 9, releasing the screen/display from its locked, erected, open position, and causing the floor to fold upwards along a medial flexible joint 7*a* which bisects the floor along a line extending from the midpoint of its outside edge 8 to a midpoint on the opposite inside edge 9, shown in View 4*a* As the floor 4 is lifted and folded back in half upon itself along a medial flexible joint 7*a*, the side walls 1 and 2 are drawn inward toward each other.

Simultaneously, the center wall 3 and adjacent optional angled top section 5*c* begin folding also along central flexible joint 7*b* and middle flexible joint 7*d* which bisect them along their vertical axes. Supplemental flexible joints 7*c* on the lower portion of center wall 3 allow the continued upward movement of the folding floor 4 into the space bounded on two sides by the inward movement of the side walls 1 with 3*a*, and 3*b* with 2, as shown in View 4*b*. The folding process is complete when the floor 4 has retracted fully into the space between side walls 1 and 2, and the screen/display has collapsed into a flat parcel, as shown in View 4*c*. The process thus described is reversed to unfold and set up the screen/display.

What is claimed is:

1. A folding convertible screen/display, having both an erected and a folded position, comprising:

a. A left, a center, and a right wall, each formed from a rigid, structural material, each having a top edge, a bottom edge, and left and right side edges, the left and center walls, and the center and right walls, each flexibly joined together along common side edges to form a continuous wall, the center wall being bisected from top edge to bottom edge by a central flexible joint, the center wall further having left and right supplemental flexible joints, each originating in respective opposite lower corners of the center wall defined by the intersection of the respective side edge of the center wall with the bottom edge of the center wall, and ending at a common point along the central flexible joint and above the bottom edge of the center wall, the center wall thereby having left and right triangular panels, each bounded by the respective supplemental flexible joint, the center wall bottom edge, and the central flexible joint common to both; and b. A floor formed from a rigid, structural material having a plurality of edges, three adjacent edges of which are flexibly joined to the bottom edges of the left, center and right walls, the floor being bisected by a medial flexible joint extending from the midpoint of the edge joined to the center wall, to the midpoint of the edge immediately opposite to the edge joined to the center wall, thus forming a left floor section and a right floor section; the two triangular panels lying in the plane of the center wall, and the left and right floor sections lying in a single plane perpendicular to the left, center and right walls, securing the folding convertible screen/display in an erected position, and the left and right triangular panels lying in the planes of the left and right floor sections, respectively, and both the floor and the center wall folding along the medial flexible joint and the center flexible joint, respectively, when the folding convertible screen/display is in its folded position.

2. The folding convertible screen/display of claim 1, wherein the screen/display left, center and right walls, and floor are formed from a single, contiguous piece of rigid, structural material, the floor being permanently and flexibly joined to the left wall at the time of forming.

3. The folding convertible screen/display of claim 1, wherein the screen/display left, center and right walls, and floor are formed from a single, contiguous piece of rigid, structural material, the floor being permanently and flexibly joined to the center wall at the time of forming.

4. The folding convertible screen/display of claim 1, wherein the screen/display left, center and right walls, and floor are formed from a single, contiguous piece of rigid, structural material, the floor being permanently and flexibly joined to the right wall at the time of forming.

5. The folding convertible screen/display of claim 1, wherein the rigid structural material is corrugated paperboard.

6. The folding convertible screen/display of claim 5, wherein permanent flexible joints are formed by scoring and folding the corrugated paperboard along lines which define the flexible joints where walls and floor are permanently and flexibly joined.

7. The folding convertible screen/display of claim 1, further comprising a left top section, a center top section and a right top section, each section formed from rigid, structural material, each section having a top edge, a bottom edge and two side edges, the left and center top sections, and the center and right top sections, each flexibly joined together along common side edges to form a continuous top, the center top section being bisected from top edge to bottom edge by a middle flexible joint, the left top section, center top section and right top section being flexibly joined at their respective bottom edges to the top edges of the left wall, center wall and right wall, respectively, the continuous top having additional flexible joints originating at the points of intersection of the common side edges and bottom edges of the left top and right top sections and extending to the top edges of the left top and right top sections, the additional flexible joints forming acute angles with the common side edges of the continuous top, and, together with the common side edges of the continuous top and the top edges of the left top and right top sections, defining left and right triangular sections which, when folded back against and temporarily fastened to the left top and right top sections, respectively, cause the left top, center top and right top sections to bend inward at the flexible joints along their bottom edges at an angle toward the screen/display floor.

8. The folding convertible screen/display of claim 7, wherein the left top section, the center top section and the right top section, the left, center and right walls, and the floor are formed from a single, contiguous piece of rigid, structural material, the floor being permanently and flexibly joined to the left wall, and the left, center and right top sections being permanently and flexibly joined to the left, center and right walls, respectively, at the time of forming.

9. The folding convertible screen/display of claim 7, wherein the left top section, the center top section and the right top section, the left, center and right walls, and the floor are formed from a single, contiguous piece of rigid, structural material, the floor being permanently and flexibly joined to the center wall, and the left, center and right top sections being permanently and flexibly joined to the left, center and right walls, respectively, at the time of forming.

10. The folding convertible screen/display of claim 7, wherein the left top section, the center top section and the right top section, the left, center and right walls, and the floor are formed from a single, contiguous piece of rigid, structural material, the floor being permanently and flexibly joined to the right wall, and the left, center and right top sections being permanently and flexibly joined to the left, center and right walls, respectively, at the time of forming.

11. The folding convertible screen/display of claim 7, wherein the rigid structural material is corrugated paperboard.

12. The folding convertible screen/display of claim 11, wherein permanent flexible joints are formed by scoring and folding the corrugated paperboard along lines which define the flexible joints where the top sections, walls and floor are permanently and flexibly joined.

* * * * *